US009455078B2

(12) United States Patent
Stout et al.

(10) Patent No.: US 9,455,078 B2
(45) Date of Patent: Sep. 27, 2016

(54) NON-LINEAR MULTI-POLE MAGNETIZATION OF FLEXIBLE MAGNETIC SHEETS

(71) Applicant: Magnum Magnetics Corporation, Marietta, OH (US)

(72) Inventors: Joseph B. Stout, Williamstown, WV (US); Douglas William Rummer, Waterford, OH (US); Derek Allen, Marietta, OH (US)

(73) Assignee: Magnum Magnetics Corporation, Marietta, OH (US)

( * ) Notice: Subject to any disclaimer, the term of this patent is extended or adjusted under 35 U.S.C. 154(b) by 0 days.

(21) Appl. No.: 14/445,925

(22) Filed: Jul. 29, 2014

(65) Prior Publication Data

US 2016/0035471 A1 Feb. 4, 2016

(51) Int. Cl.
*H01F 13/00* (2006.01)
*H01F 7/02* (2006.01)

(52) U.S. Cl.
CPC ..... *H01F 13/00* (2013.01); *H01F 7/0215* (2013.01); *H01F 7/0273* (2013.01); *H01F 13/003* (2013.01)

(58) Field of Classification Search
CPC ..... H01F 13/00
USPC ..... 335/284
See application file for complete search history.

(56) References Cited

U.S. PATENT DOCUMENTS

| | | | | |
|---|---|---|---|---|
| 2,501,615 | A * | 3/1950 | Pugh | 335/284 |
| 2,511,121 | A * | 6/1950 | Murphy | 361/437 |
| 2,897,286 | A * | 7/1959 | Atkinson et al. | 346/74.2 |
| 3,117,065 | A * | 1/1964 | Wootten | 205/90 |
| 4,099,186 | A * | 7/1978 | Edwards et al. | 346/74.7 |
| 4,379,276 | A * | 4/1983 | Bouchara et al. | 335/284 |
| 5,388,490 | A * | 2/1995 | Buck | 83/880 |
| 2003/0218525 | A1* | 11/2003 | Sugawara et al. | 335/284 |

FOREIGN PATENT DOCUMENTS

DE 3439341 A1 * 5/1986

* cited by examiner

*Primary Examiner* — Mohamad Musleh
(74) *Attorney, Agent, or Firm* — Vorys, Sater, Seymour and Pease LLP; William L. Klima; Vincent M DeLuca

(57) ABSTRACT

A non-linear multi-pole magnetization pattern is used to magnetize flexible magnetizable sheets. The non-linear pattern is produced by a magnetizing mechanism having a set of angled magnets. Shifting of magnetic sheet positions in a stack is eliminated by randomizing the positions of the multiple magnetic poles in such manner that as the magnetic sheets are stacked, each sheet will have a multi-pole configuration different from the adjacent sheets below and above it on the stack.

28 Claims, 3 Drawing Sheets

NON-LINEAR MULTI-POLE MAGNETIZATION OF FLEXIBLE MAGNETIC SHEETS

BACKGROUND

This invention relates to providing a system for improved multi-pole magnetization of flexible sheet magnets. More particularly, this invention relates to providing a system for multi-pole magnetization of flexible magnetic sheets.

A conventional flexible magnetizable sheet is magnetized with a magnetizer array that uses neodymium rare earth magnets. The standard magnets used are a 42 M grade with a 1" outer diameter and 0.250" inner diameter. The magnets are stacked on a stainless steel shaft with alternating pole orientation and spaced with steel washers between magnets. When the flexible magnetizable sheet is rolled over the array, alternating straight-line poles develop in the sheet material, which gives it a magnetic field.

The conventional process of magnetizing flexible sheets on a sheetline results in the orientation of the magnetic poles being exactly the same on each finished magnetic sheet. As a result, stacking finished flexible sheet magnets in a straight stack (such as for storage, shipping, etc.) can be difficult. Since opposite poles attract, or alternatively stated similar poles repulse, stacking such flexible magnetic sheets on top of each other often staggers the sheets in a saw tooth or zigzag formation, from the resultant alignment of the magnetic fields of each sheet, preventing straight or "neat" alignments with the edges of all sheets in the stack flush with each other.

Additionally, the force needed to "jog" such sheets into an aligned stack can damage the edges of the sheets. Further, the strong magnetic attractive force between such stacked sheets makes it difficult to separate individual sheets from the stack for use.

Additionally, in some uses of flexible magnetic sheets, external forces acting in the direction of the magnetization lines may cause the flexible magnetic sheet to slide or be dislodged from the surface to which it is magnetically adhered.

OBJECTS AND FEATURES OF THE INVENTION

An object and feature of the present invention is to provide a system overcoming the above-mentioned problems.

It is a further object and feature of the present invention to provide such a system utilizing non-linear multi-pole magnetization.

An additional object and feature of the present invention is to provide such a system, which magnetizes a magnetic sheet with a distinctive non-linear pattern of magnetization lines.

Another object and feature of the present invention is to provide such a system which diminishes alignment of magnetization lines between flexible magnetic sheets stacked together.

A further object and feature of the present invention is to provide such a system, which reduces the force needed to "jog" a stack of flexible magnetic sheets into a stacked alignment.

Yet another object and feature of the present invention is to provide such a system that allows stacking in a feed tray for use on an automated device.

An additional object and feature of the present invention is to provide such a system, which distributes magnetization directions to prevent alignment with an external force, preventing separation of flexible magnetic sheets from a surface to which it is adhered.

A further object and feature of the present invention is to provide such a system that is efficient, inexpensive, and handy. Other objects and features of this invention will become apparent with reference to the following descriptions.

SUMMARY OF THE INVENTION

In accordance with an aspect of the invention a non-linear multi-pole magnetization pattern is used to magnetize flexible magnetizable sheets. One embodiment of the invention for eliminating shifting of magnetic sheet positions in a stack is to randomize the positions of the multiple magnetic poles in such manner that as the magnetic sheets are stacked, each sheet will have a multi-pole configuration different from the adjacent sheets below and above it on the stack. This can be accomplished by angling the magnets and washers on the magnetizer array. The pole lines that will develop on the flexible magnet sheet will be non-linear or "wavy," thus making the position of each north and south pole random on any one finished magnetic sheet. Therefore when two sheets are stacked, the randomized magnetic pole pattern will result in weaker magnetic force alignment, allowing the sheets to be stacked in a straight stack.

DETAILED DESCRIPTION OF THE INVENTION

Figure 1:
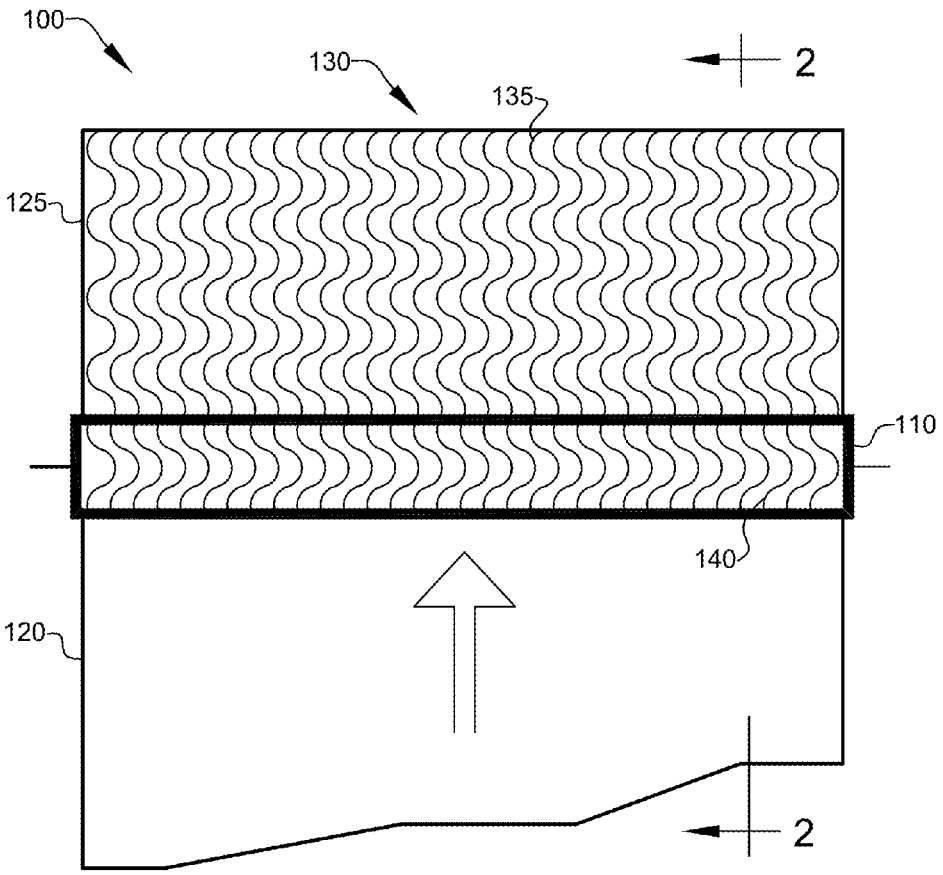
FIG. 1 shows a diagrammatic plan view illustrating multi-pole magnetization, of at least one flexible magnetizable sheet, according to a preferred embodiment of the present invention.

FIG. 1 shows a diagrammatic plan view of multi-pole magnetization system 100, illustrating multi-pole magnetization 130 of at least one flexible magnetizable sheet 120, according to a preferred embodiment of the present invention. Multi-pole magnetization system 100 preferably comprises at least one multi-pole magnetization 130 of magnetizable sheet 120, as shown. Magnetizable sheet 120 is made of a flexible magnetizable material such as, for example, a polymeric material containing embedded ferrite particles. Such flexible magnetizable sheets are well-known in the art and consequently will not be described further. Multi-pole magnetization 130 comprises at least one non-linear magnetization pattern 135, such as a sine-wave pattern as shown, or other curvilinear pattern. Other magnetization patterns, such as, for example, square waves, trapezoidal waves, triangle waves, cross-hatches, etc., also may be used.

Multi-pole magnetization 130 preferably utilizes at least one magnetizing roller 110 to magnetize flexible magnetizable sheet 120 with magnetization pattern 135, as shown, creating magnetized flexible sheet 125. Upon reading the teachings of this specification, those skilled in the art will now appreciate that, under appropriate circumstances, considering such issues as cost, future technologies, etc., other magnetization methods, such as, for example, oscillating electro-magnetic fingers, embedded permanent magnets in oscillating feed path, etc., may be used.

In one example embodiment, magnetizing roller 110 comprises a plurality of individual roller 140 (e.g. a stack of geometric wafers shaped to produce magnetization pattern 135 with magnetization lines, as shown. Individual rollers 140 alternate stacking of magnets with magnetic field conducting spacers providing multiple pairs of magnetic poles along the length of magnetizing roller 110. Each individual roller 140 preferably comprises a uniform saddle shape with an outer perimeter defining a cylinder (the diameter of which corresponds to the diameter of magnetizing roller 110). Those skilled in the art will appreciate that, under appropriate circumstances, considering such issues as cost, available materials, etc., other shapes providing a non-linear multi-pole magnetization pattern, such as, for example, ovular shapes tilted with respect to the roller axis, trapezoidal saddle shapes, triangular saddle shapes, etc., may be used. There exist multiple magnetic poles with magnetization lines provided across a width of the magnetizable sheet 120. The multiple magnetic poles and magnetization lines are spaced apart (e.g. equally spaced apart), and can have the same phase as shown along a length of the magnetizable sheet 120.

Figure 2:
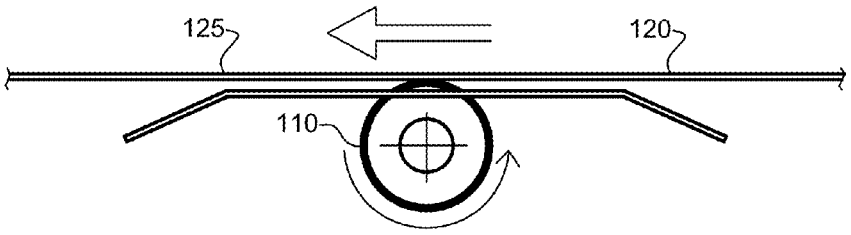
FIG. 2 shows the sectional view 2-2 of FIG. 1 according to the preferred embodiment of FIG. 1.

FIG. 2 shows the sectional view 2-2 of FIG. 1 according to the embodiment of FIG. 1. In one embodiment, flexible magnetizable sheet 120 passes across magnetizing roller 110, while magnetizing roller 110 rotates, preferably becoming magnetized with magnetization pattern 135, resulting in magnetized flexible sheet 125. Flexible magnetizable sheets 120 may be successively fed across magnetizing roller 110, preferably randomly reaching the magnetizing roller 110 at a different point on magnetizing roller 110, thus preferably randomizing the location of magnetization pole lines with respect to other magnetized flexible sheets 125. In an alternate embodiment, the flexible sheet 125 may remain stationary while the roller 110 rolls over the sheet 125 in contact therewith.

In effect, when stacked, magnetization lines within magnetization pattern 135 of successive magnetized flexible sheets 125, having been magnetized, will cross at multiple points distributed across magnetized flexible sheets 125. Applicant has found that the crossing of magnetization lines will cause magnetic field interference patterns to roughly evenly distribute attractive and repulsive forces between adjacent portions of adjacent sheets 125 within a stack, thus lessening the overall attraction between two such adjacent sheets.

This arrangement will result in easier "jogging" or sliding into physical alignment of the edges of sheets in a stack, since less force is exerted normal to the adjacent surfaces from magnetic attraction thereby creating less friction to resist the sliding movement.

In addition, while magnetized flexible sheet 125 is in use (i.e. magnetically attached to a magnetically attractive material surface), non-linear magnetization pattern 135 resists lateral movement of magnetized flexible sheet 125 on such surface. The magnetic domains within a magnetically attractive material align themselves according to the non-linear magnetization pattern 135 within magnetized flexible sheet 125, while magnetized flexible sheet 125 is magnetically attached to the magnetically attractive material surface.

Since the magnetic domains follow correspondingly to non-linear magnetization pattern 135, any shift in magnetized sheet would require changes to the magnetic domains and thereby additional energy to enact the movement. In contrast, a straight line pattern would be able to move in-line with the magnetization pattern and require no extra energy to alter the magnetic domains. Thus a non-linear pattern such as magnetization pattern 135 makes the magnetic cohesion force between magnetized flexible sheet 125 and the magnetically attractive material more consistent along any direction.

Figure 3:
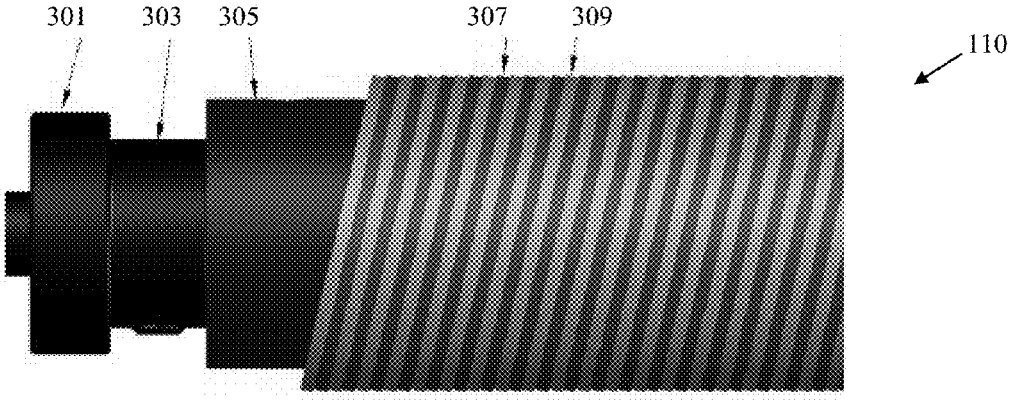
FIG. 3 shows a partial side view of another example embodiment of a magnetizer roller 110 in accordance with the invention.
Figure 4:
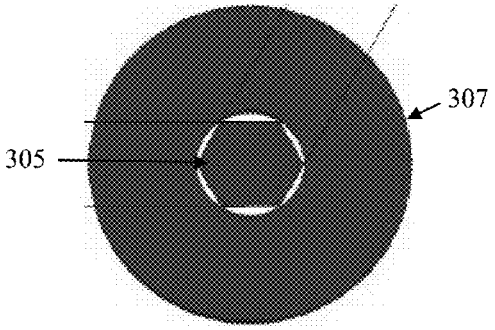
FIG. 4 is a cross-sectional view of FIG. 3.

FIG. 3 is a partial side view of another example embodiment of a magnetizing roller 110 in accordance with the invention. An alternating stack of angled magnets 307 in the shape of discs and spacers or washers 309 are mounted on a shaft 305. The shaft 305 is provided with a shaft collar 303 and a bearing 301 for mounting in a magnetic sheet forming apparatus. In one example embodiment, the magnets 307 are 42 M neodymium magnets, and the washers 309 are made of 1008/1010 steel or stainless steel. Each successive magnet 307 on the shaft 305 has a pole orientation opposite to adjacent magnets, with spacers or washers 309 placed between adjacent magnets 307. According to one example embodiment, the magnets 307 and washers 309 are mounted on shaft 305 at an angle of 13° with respect to the radial axis of the shaft 305. FIG. 4 is a cross-sectional view of the roller 110 of FIG. 3. According to one example embodiment, the magnets 307 have an inner diameter of 0.250" and an outer diameter of 1.500".

While FIG. 3 shows a fixed configuration of angled magnets, the present invention may be alternately implemented using an adjustable configuration, wherein the angle of the magnets may be varied on the shaft, such as by use of an internal cam shaft, adjusting rod, or other angle adjusting mechanism as may be known to those skilled in the art.

Figure 5:
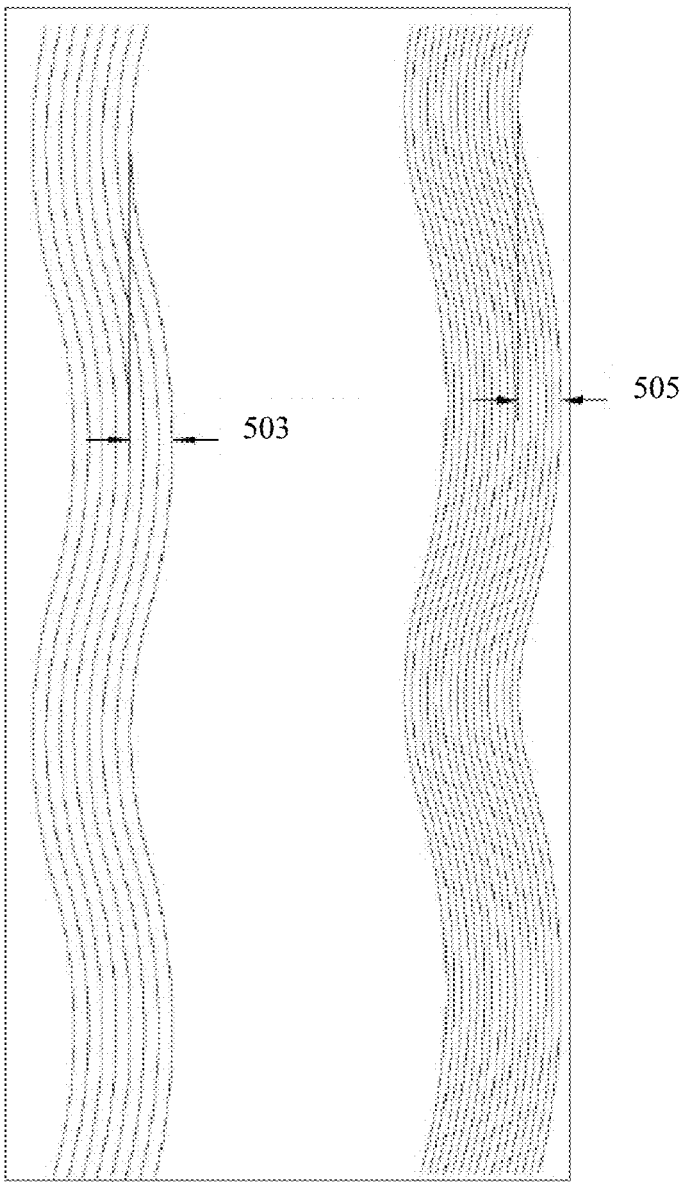
FIG. 5 shows alternate multi-pole magnetization patterns in accordance with the invention.

FIG. 5 shows alternate multi-pole magnetization patterns in accordance with the invention. Specifically, pattern 503 is produced by an 8 pole per inch array, which exhibits a 3 pole jog, while pattern 505 is produced by a 16 pole per inch array, which exhibits a 5 pole jog.

Although applicant has described preferred embodiments as examples of this invention, it will be understood that the broadest scope of this invention includes modifications such as diverse shapes, sizes, and materials. Such scope is limited only by the below claims as read in connection with the above specification.

Further, many other advantages of applicant's invention will be apparent to those skilled in the art from the above descriptions and the below claims.

What is claimed is:

1. Apparatus for producing multi-pole magnetization flexible magnetic sheets, comprising:

a magnetizing mechanism comprising a magnetizing roller configured to create a non-linear multi-pole magnetization pattern on a flexible sheet of magnetizable material, wherein said magnetizing roller comprises a shaft with a plurality of magnets arranged on said shaft at a non-zero angle with respect to a radial axis of said shaft, and wherein said flexible sheet of magnetizable material is passed over said magnetizing roller in contact with said magnets to produce said non-linear multi-pole magnetization pattern.

2. Apparatus as set forth in claim 1, wherein said magnets are fixed on said shaft at said non-zero angle.

3. Apparatus as set forth in claim 1, wherein said angle of said magnets with respect to said radial axis is adjustable.

4. Apparatus as set forth in claim 1, wherein said non-zero angle is 13°.

5. Apparatus as set forth in claim 1, further comprising at least one spacer mounted on said shaft between successive magnets.

6. Apparatus as set forth in claim 1, wherein said magnetizing mechanism comprises a plurality of geometric magnet wafers each having a uniform saddle shape with an outer perimeter defining a cylinder.

7. Apparatus as set forth in claim 1, wherein said magnets are configured in the shape of discs.

8. A flexible magnetic sheet having a non-linear multi-pole magnetization pattern formed thereon, said non-linear multi-pole magnetization pattern comprising multiple magnetization lines spaced apart across a width of the flexible magnetic sheet, said flexible magnetic sheet made using the apparatus according to claim 1.

9. The flexible magnetic sheet as set forth in claim 8, wherein said magnetization pattern is a curvilinear pattern.

10. The flexible magnetic sheet as set forth in claim 8, wherein said magnetization pattern is a wave pattern.

11. The flexible magnetic sheet as set forth in claim 10, wherein said wave pattern is a sine wave pattern.

12. The flexible magnetic sheet as set forth in claim 8, wherein said magnetization lines have a repeating pattern.

13. The flexible magnetic sheet as set forth in claim 8, wherein said magnetization lines are spaced apart.

14. The flexible magnetic sheet as set forth in claim 13, wherein said magnetization lines are equally spaced apart.

15. The flexible magnetic sheet as set forth in claim 8, wherein said magnetization lines repeat across a width of the flexible magnetic sheet.

16. The flexible magnetic sheet as set forth in claim 8, wherein said magnetization lines of said non-linear multi-pole patterns are in a same phase along a length of the flexible magnetic sheet.

17. Apparatus as set forth in claim 1, wherein said magnetization pattern is a curvilinear pattern.

18. Apparatus as set forth in claim 1, wherein said magnetization pattern is a wave pattern.

19. Apparatus as set forth in claim 18, wherein said wave pattern is a sine wave pattern.

20. Apparatus for producing multi-pole magnetization flexible magnetic sheets, comprising:

a magnetizing mechanism comprising a magnetizing roller configured to create a non-linear multi-pole magnetization pattern on a flexible sheet of magnetizable material, said magnetizing roller comprising multiple individual magnetizing rollers supported on a rotating shaft, wherein said apparatus is configured so that said flexible sheet of magnetizable material is passed over said magnetizing roller in contact with said magnets to produce said non-linear multi-pole magnetization pattern.

21. Apparatus as set forth in claim 20, wherein said individual magnetizing rollers are arranged side-by-side.

22. Apparatus as set forth in claim 21, wherein said individual magnetizing rollers are saddle shaped.

23. Apparatus as set forth in claim 21, wherein said individual magnetizing rollers are uniform saddle shaped.

24. Apparatus as set forth in claim 21, wherein said individual magnetizing rollers alternate stacking of magnets with magnetic field conducting spacers providing multiple pairs of magnetic poles along a length of said magnetizing roller.

25. Apparatus as set forth in claim 20, wherein said individual magnetizing rollers are spaced apart.

26. Apparatus as set forth in claim 1, wherein said non-linear multi-pole magnetization pattern comprises multiple poles and at least one pole jog.

27. Apparatus as set forth in claim 1, wherein said non-linear multi-pole magnetization pattern comprises 8 poles per inch array, which exhibits a 3 pole jog.

28. Apparatus as set forth in claim 1, wherein said non-linear multi-pole magnetization pattern comprises 16 poles per inch array, which exhibits a 5 pole jog.

* * * * *